United States Patent [19]

Strobel et al.

[11] Patent Number: 4,557,205

[45] Date of Patent: Dec. 10, 1985

[54] FUR SEWING MACHINE WITH HEATED AIR BLOWER

[75] Inventors: Alfons Strobel, Grunwald; Hans Wagner; Georg Hauser, both of Munich, all of Fed. Rep. of Germany

[73] Assignee: J. Strobel & Sohne GmbH & Co., Fed. Rep. of Germany

[21] Appl. No.: 642,159

[22] Filed: Aug. 20, 1984

[30] Foreign Application Priority Data

Aug. 26, 1983 [DE] Fed. Rep. of Germany ..... 3330877

[51] Int. Cl.[4] ..... D05B 23/00

[52] U.S. Cl. ..... 112/20; 112/2; 34/90; 219/373

[58] Field of Search ..... 139/291 R, 1 C; 112/DIG. 2, DIG. 3, 2, 20, 149, 282; 223/43; 219/373, 374, 375; 34/90

[56] References Cited

U.S. PATENT DOCUMENTS

| | | | |
|---|---|---|---|
| 2,588,281 | 3/1952 | Olday . | |
| 3,560,710 | 2/1971 | Fuellemann | 219/373 |
| 3,572,268 | 3/1971 | Olday . | |
| 3,650,227 | 3/1972 | Olday . | |
| 3,770,201 | 11/1973 | Sanders | 219/374 X |
| 3,816,706 | 6/1974 | Meywald | 219/374 X |
| 3,846,618 | 11/1974 | Henderlite, III | 219/374 |
| 3,898,429 | 8/1975 | Chodak | 219/373 X |
| 4,094,258 | 6/1978 | Bonis . | |
| 4,098,202 | 7/1978 | Marforio et al. . | |
| 4,456,818 | 6/1984 | McCollugh et al. | 219/373 |

FOREIGN PATENT DOCUMENTS

| | | | |
|---|---|---|---|
| 951606 | 10/1956 | Fed. Rep. of Germany . | |
| 2702258 | 5/1978 | Fed. Rep. of Germany | 112/20 |
| 1033276 | 6/1966 | United Kingdom | 139/291 R |

*Primary Examiner*—Werner H. Schroeder
*Assistant Examiner*—Andrew M. Falik
*Attorney, Agent, or Firm*—Bacon & Thomas

[57] ABSTRACT

A fur sewing machine having a blower device connected with a source of compressed air which deflects the fur hairs of the material to be sewn during sewing. The connecting line between the source of the compressed air and the blower contains a heating device which heats the compressed air. A mechanism for controlling the air flow and the heater is also provided.

10 Claims, 3 Drawing Figures

FUR SEWING MACHINE WITH HEATED AIR BLOWER

BACKGROUND OF THE INVENTION

1. Field of the Invention

The invention relates to a fur sewing machine having a blower which causes air to deflect hairs of the furs from the area which is being sewn.

2. Description of the Prior Art

Examples of such sewing machines can be seen in German Patents DE P 951 606, 20 24 284, 27 02 258 and 27 20 444, and German Specification DE-OS 20 65 037. During the sewing operation, a blower device delivers a flow of compressed air or a plurality of partial flows of compressed air in order to deflect the hairs of the fur from the area of the seam to be produced so that they will not be sewn into the seam. The compressed air emanating in the process is considered by the operating personnel to be both disagreeable and a disturbance because it felt as a cold draft which can cause illness.

SUMMARY OF THE INVENTION

It is an object of the invention to provide a fur sewing machine in which these disadvantages are eliminated.

According to the invention, the compressed air supplied to the blower device is heated to a temperature such that following the discharge of the compressed air from the blower, there is no sensation of a draft by the operating personnel and no impairment of their well being and of their actual state of health. For example, the compressed air may be heated to a temperature between approximately 35° C. and approximately 60° C. so that after its exit from the blower, the compressed air is at a temperature which will not evoke a sensitive reaction of the human body.

A mechanism for controlling the air flow and the heater is provided for advantageous operation of the device.

DESCRIPTION OF THE PREFERRED EMBODIMENT

Figure 1:
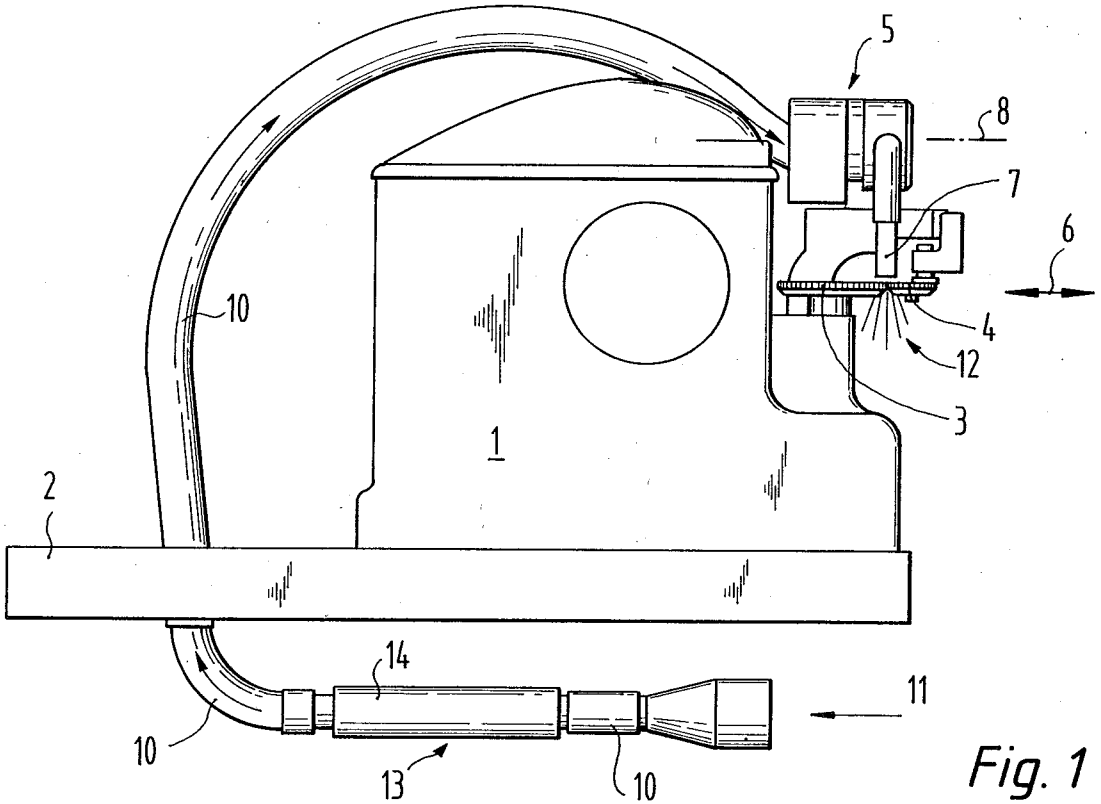
FIG. 1 shows a front elevation of a fur sewing machine according to the invention.

The fur sewing machine 1 is shown in FIG. 1 to be arranged on a horizontal table top 2. It is equipped with two transport disks 3 and 4, and a blower device 5.

Transport disks 3 and 4 are located in the same horizontal plane. Each may be rotated around a vertical axis. Inner transport disk 3 is mounted on the upper end of a vertical shaft which is rotatively supported in the housing 1 of the fur sewing machine and is driven intermittently. Outer transport disk 4 is arranged to be horizontally displaceable in the direction of double arrow 6 and is spring loaded toward inner transport disk 3. During the sewing operation, transport disks 3 and 4 move the fur pieces to be sewn in a direction which is into and perpendicular to the plane of the drawing of FIG. 1.

The hairy sides of the two pieces of fur are arranged to face each other. Transport disks 3 and 4 press the edges of the fur pieces together so that they may be pierced and sewn by the sewing needle of the fur sewing machine. The sewing needle moves back and forth above transport disks 3 and 4, parallel to the double arrow 6. In cooperation with the hook finger of the fur sewing machine 1, the sewing needle forms a seam which joins the edges of the two pieces of fur together.

To prevent the hairs of the two pieces of fur from being sewn into the seam, the hairs must be deflected from the area where the seam is produced prior to the entry of the two edges of the fur pieces between transport disks 3 and 4. This is accomplished by using a blower device 5 with a blow tube 7 which directs air, that is supplied by a source 11 of compressed air, toward the fur pieces in the sewing area when blowing device 5 and blow tube 7 are in an operating position. Blow tube 7 is pivotable around a horizontal axis between the operating position shown and a rest position, where it is moved up and away from transport disks 3 and 4. Blower device 5 is connected to a source 11 of compressed air by a connecting line 10. When it is charged with compressed air in the operating position according to FIG. 1, a flow of compressed air or a plurality of partial flows 12 of compressed air exits from the blow tube 7. This causes the fur hairs of the material to be sewn to be deflected in a direction downward in FIG. 1 and away from the edges arriving between transport disks 3 and 4.

Heating device 13 is provided in connecting line 10 between the source of compressed air 11 and blower device 5 to heat the compressed air supplied to blower device 5. The heating device 13 has a pipe fitting 14 with at least one internal heating element. Pipe fitting 14 includes a pipe portion and fittings which engage connecting line 10. The compressed air flows through the arrangement and is heated. If necessary, the heating element is equipped with external thermal insulation. The heating element or elements may include an electric resistance heater. It is particularly advantageous to equip the pipe fitting 14 with a helical electric resistance heater extending between the ends of pipe fitting 14, along an imaginary cylindrical surface which is coaxial with pipe fitting 14.

Figure 2:
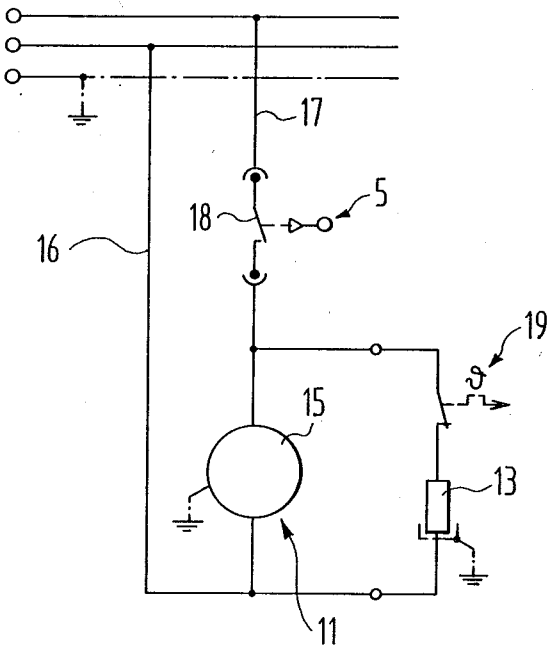
FIG. 2 is a circuit diagram of an electrical circuit for one source of compressed air and a heating device for the fur sewing machine according to FIG. 1.

According to FIG. 2, the source of compressed air 11 consists of a blower 15 having a mechanism which can generate pressurized air thru the use of an impeller that is driven by an electric motor. Blower 15 is supplied with electric power through two electrical conduits 16 and 17. Parallel to blower 15, heating device 13 is connected to conduits 16 and 17. An electric switch 18 is provided in the electric line 17. It is open when the blower device 5 and its blow tube 7 are in their rest position and closed when blower devices 5 and its blow tube 7 are pivoted into the operating position shown in FIG. 1. The electric circuit in FIG. 2 shows how switch 18 either simultaneously actuates or deactuates heating device 11 and blower 15 depending on whether blower device 5 and blow tube 7 are pivoted to the rest position or the operating position. In this manner, blower device 5 is supplied with heated compressed air when it is in the operating position and is not supplied with heated compressed air when it is in the rest position.

The heating capacity of heating device 13 is chosen so that the compressed air supplied by blower 15 is heated from room temperature to the temperature desired, which is generally between about 35° C. and 60° C. If the temperature of the compressed air emanating from heating device 13 should exceed a predetermined upper limit as the result of a defect, a heat sensitive switch 19, connected in series with heating device 13 heating element, opens automatically to disconnect heating device 13.

Figure 3:
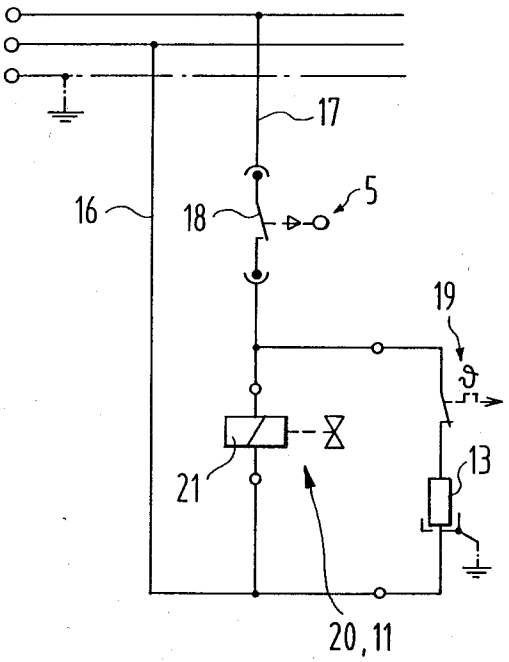
FIG. 3 is a circuit diagram of an electrical circuit for a different source of compressed air and a heating device for the fur sewing machine according to FIG. 1.

Instead of equipping fur sewing machine 1 according to FIG. 1 with a blower 15 as the source 11 of compressed air, the connecting line 10 of the fur sewing machine 1 may be connected with a compressed air system and controlled by an electromagnetic shutoff valve 20. With this arrangement valve 20 and the compressed air system would constitute the source 11 of compressed air shown in FIG. 1. FIG. 3 shows the electrical control system for this arrangement. The electric circuit for the source 11 of compressed air and the heating device 13 is identical to that shown in FIG. 2 except that electric lines 16 and 17 are now connected with an electromagnet 21 which operates a shutoff valve 20. Upon closing electric switch 18, heating device 13 is actuated and electromagnet 21 is energized to open shutoff valve 20. Compressed air then flows from the compressed air system through connecting line 10 and heating device 13 to blower device 5. When switch 18 opens, the power to heating device 13 and electromagnet 21 of shutoff valve 20 is interrupted. Heating device 13 then becomes inoperative and shutoff valve 20 closes, causing the supply of heated compressed air to blower device 5 to be discontinued.

What is claimed is:

1. A fur sewing machine with a blowing arrangement for deflecting the hairs of fur pieces from the area being sewn, which blowing arrangement comprises a blower device, a source of compressed air, a connecting line between the source of compressed air and the blower device for supplying compressed air to the blower device, the blower device being mounted on the sewing machine so as to enable discharge of the compressed air in a direction that deflects the hairs of the fur pieces in the area being sewn, a heating device disposed in the connecting line for heating the compressed air, the heating device including a pipe fitting, the pipe fitting having a pipe portion and fittings at each end thereof for engaging the connecting line so that compressed air may flow through the pipe fitting, a helical electric resistance heater disposed within the pipe fitting, which resistance heater is coaxial with the pipe fitting and extends between the ends thereof.

2. A fur sewing machine according to claim 1 further including control means for causing the heating device and the source of compressed air to be simultaneously activated and simultaneously deactivated.

3. A fur sewing machine according to claim 2 wherein the source of compressed air includes a powering means which is activated and deactivated by controlling the supply of electricity to the powering means.

4. A fur sewing machine according to claim 2 wherein the source of compressed air includes a compressed air system having an electromagnetically-operated control valve means which is activated and deactivated by controlling the supply of electricity to the valve means.

5. A fur sewing machine according to claim 1 further including a switch means for automatically deactivating the heating device when the temperature of the compressed air exceeds a predetermined value.

6. A fur sewing machine according to claim 1 wherein the blower device further includes a blow tube defining an exit nozzle for the compressed air, and wherein the blower device is movable for selectively directing the blow tube either towards the area being sewn when in an operating position or away from the area being sewn when in a rest position.

7. A fur sewing machine according to claim 6 wherein the blower device further includes control means for activating the heating device and the source of compressed air when the blower device is in the operating position, and deactivating the heating device and source of compressed air when the blower device is in the rest position.

8. A fur sewing machine according to claim 7 wherein the blower device is supported for pivotal movement about an axis.

9. A fur sewing machine with a blowing arrangement for deflecting the hairs of fur pieces from the area being sewn, which blowing arrangement comprises a blower device, a source of compressed air, a connecting line betwen the source of compressed air and the blower device for supplying compressed air to the blower device, the blower device being mounted on the sewing machine so as to enable discharge of the compressed air in a direction that deflects the hairs of the fur pieces in the area being sewn, the blower device including a blow tube defining an exit nozzle for the compressed air, the blower device being movable so as to selectively direct the blow tube towards the area being sewn when in an operating position or away from the area being sewn when in a rest position, a heating device disposed in the connecting line for heating the compressed air, control means for causing the heating device and the source of compressed air to be activated when the blower device is in the operating position and causing the heating device and source of compressed air to be deactivated when the blower device is in the rest position.

10. A fur sewing machine according to claim 9 wherein the blower device is supported for pivotal movement about an axis.

* * * * *